US008912875B1

(12) United States Patent
Tsai et al.

(10) Patent No.: US 8,912,875 B1
(45) Date of Patent: Dec. 16, 2014

(54) TRANSFORMER AND TRANSFORMER WINDING

(71) Applicant: 3 Y Power Technology (Taiwan), Inc., Guishan (Taoyuan) (TW)

(72) Inventors: Chih-Chang Tsai, Guishan (Taoyuan) (TW); Shao-Feng Lu, Guishan (Taoyuan) (TW)

(73) Assignee: 3 Y Power Technology (Taiwan), Inc., Guishan (Taoyuan) (TW)

( * ) Notice: Subject to any disclaimer, the term of this patent is extended or adjusted under 35 U.S.C. 154(b) by 0 days.

(21) Appl. No.: 14/325,470

(22) Filed: Jul. 8, 2014

(30) Foreign Application Priority Data

Jul. 9, 2013 (TW) ..... 102124512 A

(51) Int. Cl.
*H01F 27/30* (2006.01)

(52) U.S. Cl.
USPC ..... 336/206

(58) Field of Classification Search
USPC ..... 336/173, 180–184, 200, 232, 192
See application file for complete search history.

(56) References Cited

U.S. PATENT DOCUMENTS

| | | | | |
|---|---|---|---|---|
| 7,176,775 | B2 * | 2/2007 | Ohta | 336/200 |
| 8,299,886 | B2 * | 10/2012 | Won et al. | 336/221 |
| 2006/0038650 | A1 * | 2/2006 | Mehrotra et al. | 336/83 |

* cited by examiner

*Primary Examiner* — Tuyen Nguyen
(74) *Attorney, Agent, or Firm* — Abelman, Frayne & Schwab

(57) ABSTRACT

A transformer winding includes a flexible metal plate having an outer periphery defining opposite first and second sides and opposite third and fourth sides. The flexible metal plate has a trunk region that extends from the second side toward the first side and that terminates at a terminating line between the first and second sides, and is formed with a cutting line that extends from the first side toward the second side and that terminates at the terminating line. The cutting line configures the flexible metal plate with first and second branch regions, each having a winding part covered with an electrical insulation layer.

14 Claims, 6 Drawing Sheets

TRANSFORMER AND TRANSFORMER WINDING

CROSS-REFERENCE TO RELATED APPLICATIONS

This application claims priority of Taiwanese Application No. 102124512, filed on Jul. 9, 2013.

BACKGROUND OF THE INVENTION

1. Field of the Invention

The present invention relates to a transformer and to a transformer winding.

2. Description of the Related Art

A conventional transformer generally includes two conductors and transfers energy therebetween through electromagnetic induction. The conductors are generally copper coils.

Ideally, a ratio of primary voltage at a primary coil to a secondary voltage at a secondary coil is proportional to a turns ratio, which is a ratio of a number of winding turns of the primary coil to a number of winding turns of the secondary coil, an a ratio of a primary current at the primary coil to a secondary current at the secondary coil is inversely proportional to the turns ratio. Therefore, the coil having the greater number of winding turns generally has a higher voltage and a lower current, while the coil having the smaller number of winding turns generally has a lower voltage and a higher current.

However, a comparatively thicker copper coil is required to conduct a larger current, which results in generation of more heat and a bigger overall size of the transformer. Moreover, a conventional winding formed from a plurality of electrical-conductive rings uses positioning rods for connections among the rings, thereby increasing difficulties in manufacture and assembling of the abovementioned components. Furthermore, since the electrical-conductive rings and the positioning rods may be made of different materials, line loss during operation easily occurs.

SUMMARY OF THE INVENTION

Therefore, an object of the present invention is to provide a transformer winding that may alleviate the above drawbacks of the prior art.

Accordingly, a transformer winding of the present invention includes a flexible metal plate, a first electrical insulation layer and a second electrical insulation layer.

The flexible metal plate has an outer periphery defining a first side and a second side that are opposite to each other and a third side and a fourth side that are opposite to each other. The flexible metal plate has a first trunk region that extends from the second side toward the first side and that terminates at a first terminating line between the first side and the second side. The flexible metal plate is formed with a first cutting line that extends from the first side toward the second side, that is disposed between the third side and the fourth side, and that terminates at the first terminating line.

The first cutting line configures the flexible metal plate with a first branch region and a second branch region. Each of the first branch region and the second branch region has a first end part, a second end part opposite to the first end part and connected to the first trunk region, and a winding part that is connected between the first end part and the second end part.

Each of the first and second electrical insulation layers covers the winding part of a respective one of the first branch region and the second branch region.

Another object of the present invention is to provide a transformer that may alleviate the above drawbacks of the prior art.

According to another aspect, a transformer of the present invention includes a coil bobbin, an insulated coil, a core member and a transformer winding.

The insulated coil is wound on the coil bobbin. The core member is coupled to the coil bobbin in a manner that the insulated coil surrounds the core member. The transformer winding is coupled inductively to the insulated coil and includes a flexible metal plate, a first electrical insulation layer and a second electrical insulation layer.

The flexible metal plate has an outer periphery defining a first side and a second side that are opposite to each other and a third side and a fourth side that are opposite to each other. The flexible metal plate has a first trunk region that extends from the second side toward the first side and that terminates at a first terminating line between the first side and the second side. The flexible metal plate is formed with a first cutting line that extends from the first side toward the second side, that is disposed between the third side and the fourth side, and that terminates at the first terminating line.

The first cutting line configures the flexible metal plate with a first branch region and a second branch region. Each of the first branch region and the second branch region has a first end part, a second end part opposite to the first end part and connected to the first trunk region, and a winding part that is connected between the first end part and the second end part. Each of the first and second electrical insulation layers covers the winding part of a respective one of the first branch region and the second branch region.

The transformer winding is disposed to surround the insulated coil with the winding part of each of the first branch region and the second branch region extending around an outer side of the insulated coil.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
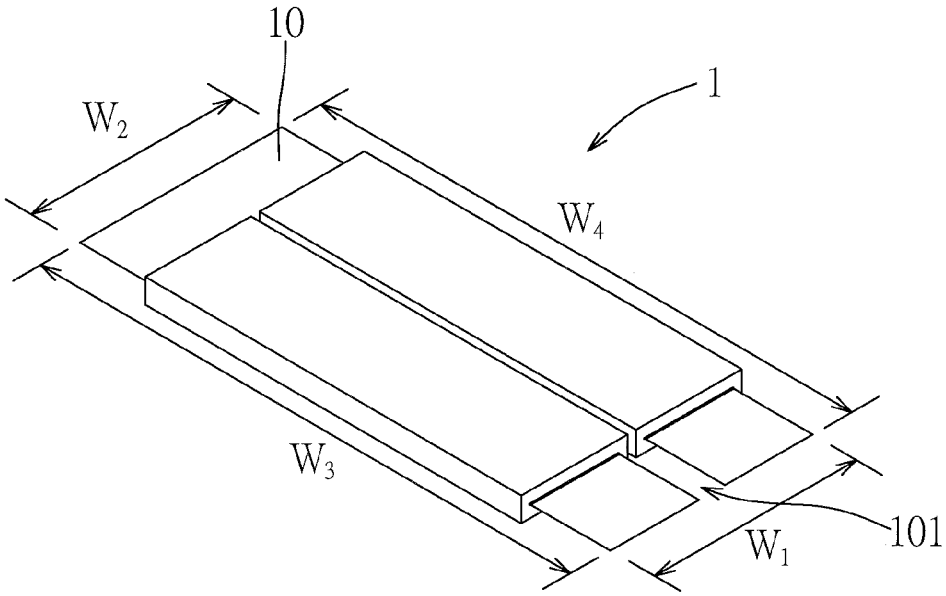
FIG. 1 is a schematic perspective view of a first preferred embodiment of a trans former winding according to the preset invention.
Figure 2:
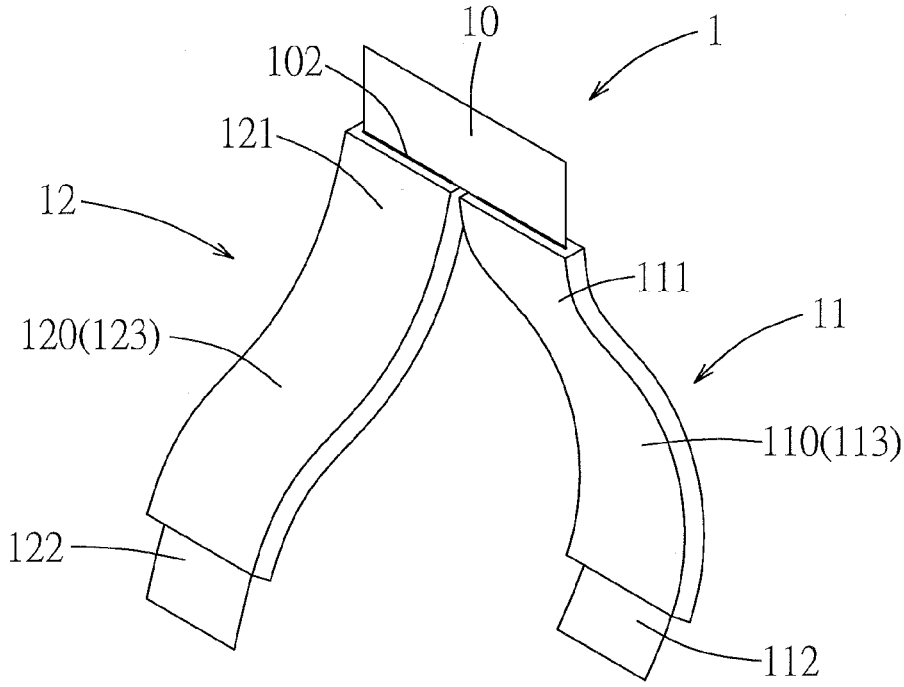
FIG. 2 is a schematic perspective view of the first preferred embodiment of the transformer winding for illustrating flexibility thereof.
Figure 3:
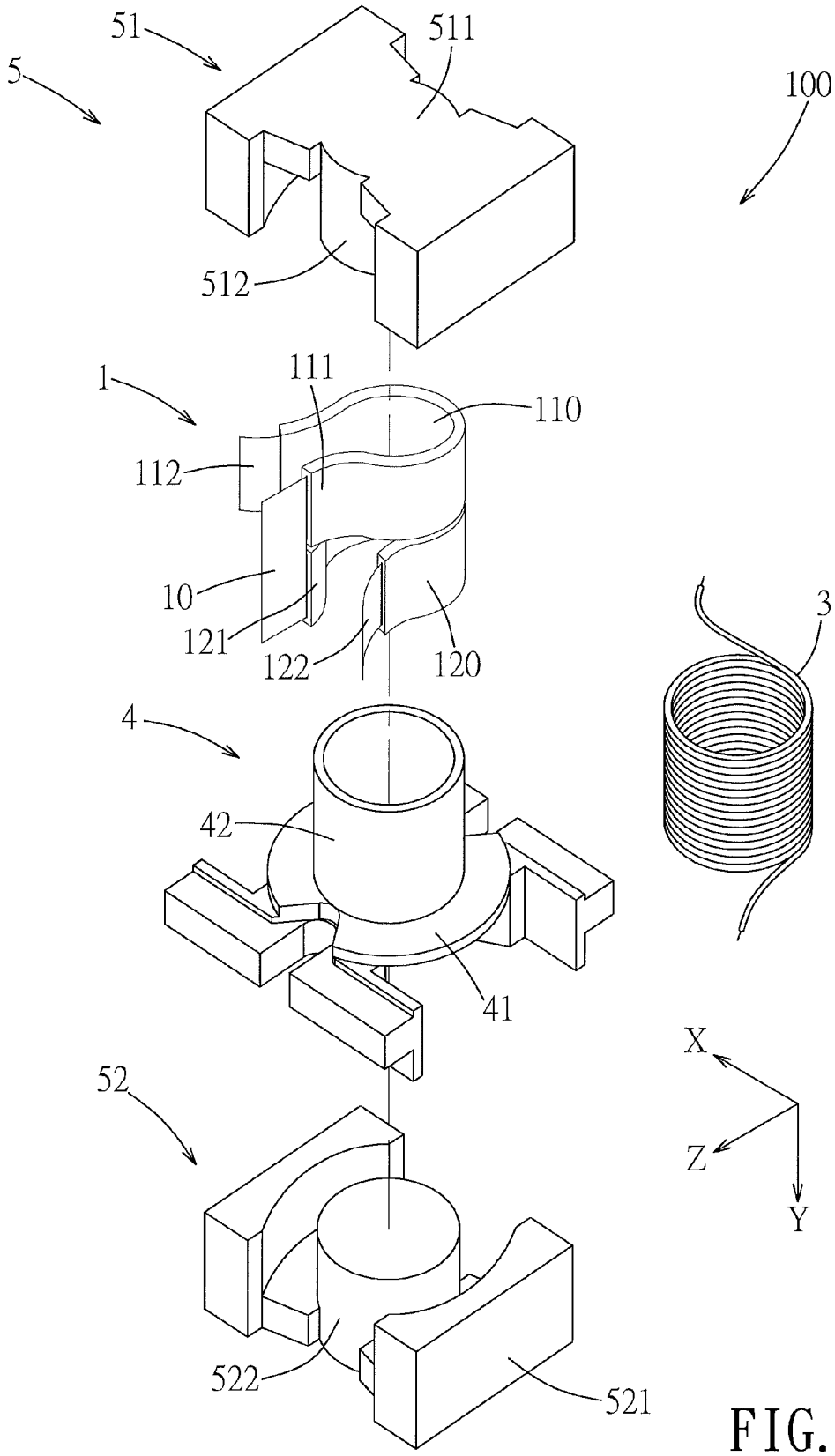
FIG. 3 is a schematic exploded perspective view of a first preferred embodiment of a transformer according to the present invention.

Referring to FIGS. 1 to 3, in a first preferred embodiment of the present invention, a transformer winding 1 is configured to couple inductively to an insulated coil 3 in a transformer 100.

The transformer winding 1 includes a flexible metal plate, a first electrical insulation layer 113 and a second electrical insulation layer 123 (which will be described later). The flexible metal plate has an outer periphery defining a first side ($W_1$) and a second side ($W_2$) that are opposite to each other and a third side ($W_3$) and a fourth side ($W_4$) that are opposite to each other. The flexible metal plate has a trunk region 10 that extends from the second side ($W_2$) toward the first side ($W_1$) and that terminates at a first terminating line 102 between the first side ($W_1$) and the second side ($W_2$). The flexible metal plate is formed with a first cutting line 101 that extends from the first side ($W_1$) toward the second side ($W_2$), that is disposed between the third side ($W_3$) and the fourth side ($W_4$), and that terminates at the first terminating line 102.

The first cutting line 101 is an elongated slot that configures the flexible metal plate with a first branch region 11 and a second branch region 12. The first branch region 11 has a first end part 112, a second end part 111 and a winding part 110. The second end part 111 of the first branch region 11 is opposite to the first end part 112 and is connected to the trunk region 10. The winding part 110 of the first branch region 11 is connected between the first end part 112 and the second end part 111, is covered by the first electrical insulation layer 113, and extends around the insulated coil 3 in a first predetermined direction (e.g., a counterclockwise direction as shown in FIG. 3). The second branch region 12 has a first end part 122, a second end part 121 and a winding part 120. The second end part 121 of the second branch region 12 is opposite to the first end part 122 and is connected to the trunk region 10. The winding part 120 of the second branch region 12 is connected between the first end part 122 and the second end part 121, is covered by the second electrical insulation layer 123, and extends around the insulated coil 3 in a second predetermined direction (e.g., a clockwise direction as shown in FIG. 3).

The transformer 100 in this preferred embodiment includes the transformer winding 1, the insulated coil 3, a coil bobbin 4 and a core member 5.

The coil bobbin 4 includes a base 41 and a tube 42 extending upward from the base 41 in a −Y direction.

The core member 5 includes a first case 51 and a second case 52 for combining vertically with the first case 51. The first case 51 has a first frame 511 and a first magnetically permeable pillar 512 connected to the first frame 511. The second case 52 has a second frame 521 and a second magnetically permeable pillar 522 connected to the second frame 521. When the first case 51 is combined vertically with the second case 52 in a Y direction to sandwich the coil bobbin 4, the first and second magnetically permeable pillars 512, 522 extend respectively into the tube 42 of the coil bobbin 4 in the Y and −Y directions to connect with each other, and the first and second frames 511, 521 cooperate with the first and second magnetically permeable pillars 512, 522 to define a winding space for accommodating the insulated coil 3 and a portion of the transformer winding 1.

The insulated coil 3 is wound on the tube 42 of the coil bobbin 4 so as to surround the first and second magnetically permeable pillars 512, 522 of the core member 5. The transformer winding 1 is disposed to surround the insulated coil 3 so as to couple inductively with the insulated coil 3.

Figure 4:
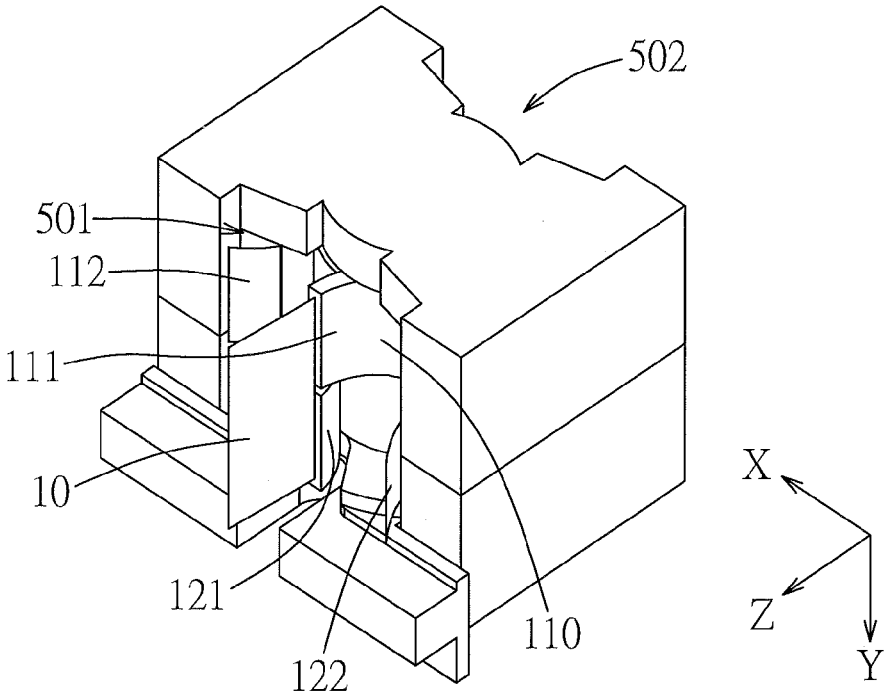
FIG. 4 is a schematic assembled perspective view of the first preferred embodiment of the transformer.

Referring further to FIG. 4, the core member 5 is configured with first and second openings 501, 502 along a Z direction that are in spatial communication with the winding space. During assembling, the winding part 110 of the first branch region 11 extends around an upper part of the insulated coil 3 in the counterclockwise direction and the winding part 120 of the second branch region 12 extends around a lower part of the insulated coil 3 in the clockwise direction. The trunk region 10, the first end part 112 of the first branch region 11 and the first end part 122 of the second branch region 12 extend in the Z direction through the first opening 501 and extend outward of the core member 5. It is noted that the trunk region 10, the first end part 112 of the first branch region 11 and the first end part 122 of the second branch region 12 are metal without being covered by any electrical insulation layer thereon so as to permit electrical connection with an electrical circuit (such as a circuit board, not shown).

Figure 5:
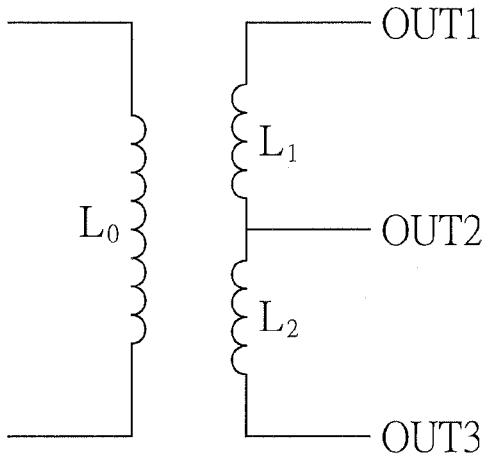
FIG. 5 is a circuit diagram for illustrating an equivalent circuit of the transformer of FIG. 4.

Referring further to FIG. 5, equivalent inductances of the insulated coil 3, the winding part 110 of the first branch region 11 and the winding part 120 of the second branch region 12 in FIG. 4 are respectively represented by $L_0$, $L_1$ and $L_2$ in FIG. 5. The first end part 112 of the first branch region 11, the trunk region 10 and the first end part 122 of the second branch region 12 in FIG. 4 are respectively represented as OUT1, OUT2 and OUT3 in FIG. 5.

Figure 6:
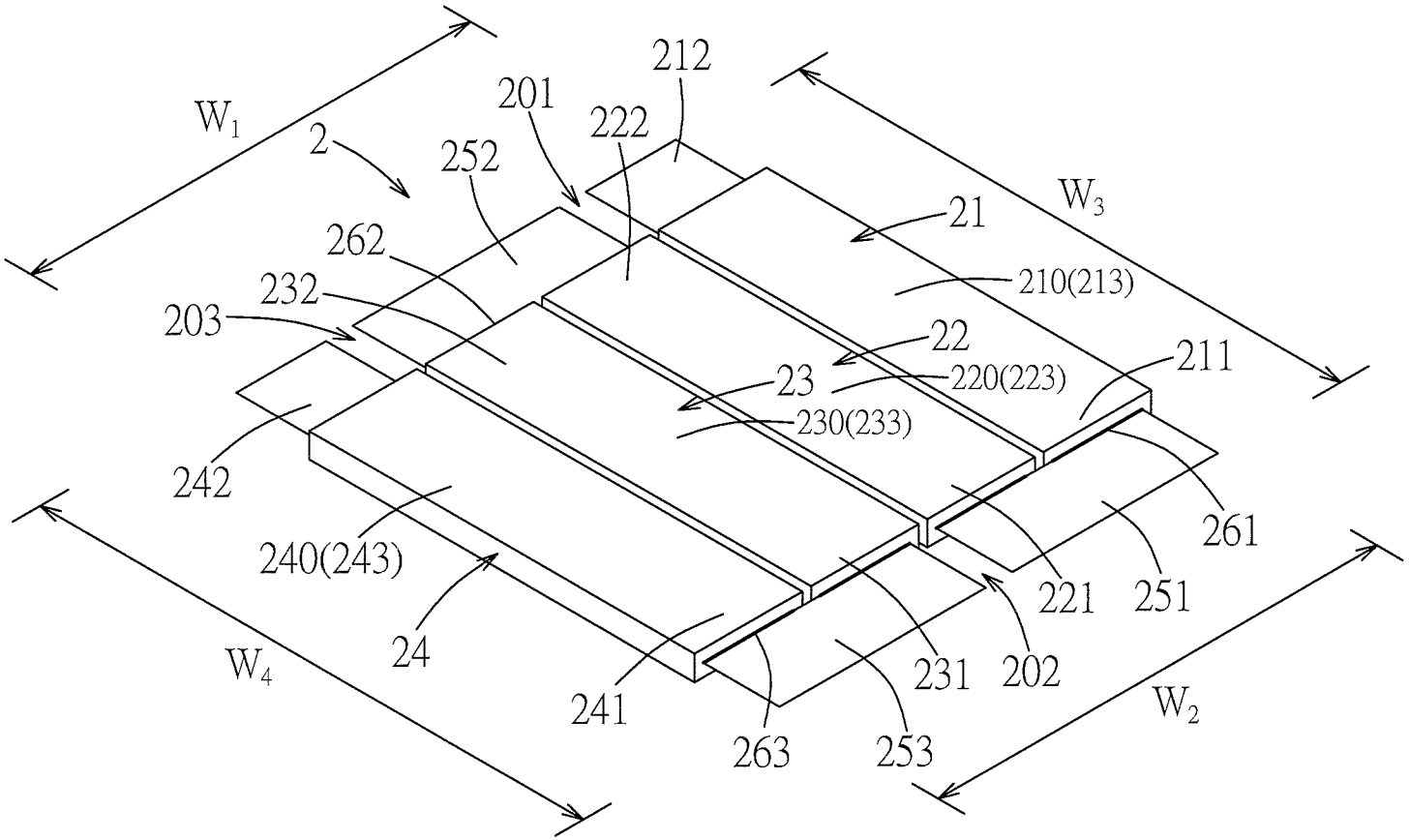
FIG. 6 is a schematic perspective view of a second preferred embodiment of a transformer winding according to the present invention.
Figure 7:
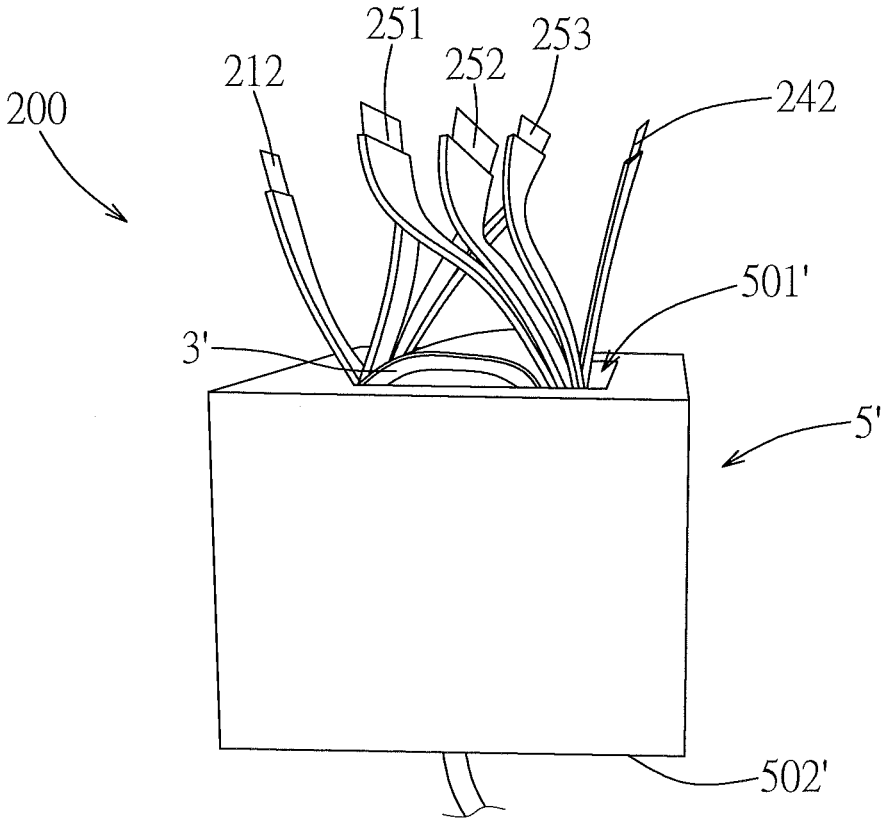
FIG. 7 is a schematic assembled perspective view of a second preferred embodiment of a transformer according to the present invention.

Referring to FIGS. 6 and 7, in a second preferred embodiment of the present invention, a transformer winding 2 is configured to couple inductively to an insulated coil 3' in a transformer 200. The transformer winding 2 includes a flexible metal plate, a first electrical insulation layer 213, a second electrical insulation layer 223, a third electrical insulation layer 233 and a fourth electrical insulation layer 243. The flexible metal plate has an outer periphery defining a first side ($W_1$) and a second side ($W_2$) that are opposite to each other and a third side ($W_3$) and a fourth side ($W_4$) that are opposite to each other.

In this preferred embodiment, the flexible metal plate has a first trunk region 251, a second trunk region 252 and a third trunk region 253. The first trunk region 251 extends from the second side ($W_2$) toward the first side ($W_1$) and terminates at a first terminating line 261 between the first side ($W_1$) and the second side ($W_2$). The second trunk region 252 extends from the first side ($W_1$) toward the second side ($W_2$) and terminates at a second terminating line 262 between the first side ($W_1$) and the second side ($W_2$). The third trunk region 253 extends from the second side ($W_2$) toward the first side ($W_1$) and terminates at a third terminating line 263 between the first side ($W_1$) and the second side ($W_2$). The flexible metal plate is formed with a first cutting line 201, a second cutting line 202 and a third cutting line 203 that are arranged sequentially from the third side ($W_3$) to the fourth side ($W_4$). The first cutting line 201 extends from the first side ($W_1$) toward the second side ($W_2$), is disposed between the third side ($W_3$) and the fourth side ($W_4$), and terminates at the first terminating line 261. The second cutting line 202 extends from the second side ($W_2$) toward the first side ($W_1$), is disposed between the first cutting line 201 and the fourth side ($W_4$), and terminates at the second terminating line 262. The third cutting line 203 extends from the first side ($W_1$) toward the second side ($W_2$), is disposed between the second cutting line 202 and the fourth side ($W_4$), and terminates at the third terminating line 263.

The first, second and third cutting lines 201, 202, 203 configure the flexible metal plate with a first branch region 21, a second branch region 22, a third branch region 23 and a fourth branch region 24 that are arranged sequentially from the third side ($W_3$) to the fourth side ($W_4$). The first branch region 21 has a first end part 212, a second end part 211 and a winding part 210. The second end part 211 is opposite to the first end part 212 and is connected to the first trunk region 251. The winding part 210 is connected between the first end part 212 and the second end part 211, and is covered by the first electrical insulation layer 213. The second branch region 22 has a first end part 222, a second end part 221 and a winding part 220. The first end part 222 is connected to the second trunk region 252. The second end part 221 is opposite to the first end part 222 and is connected to the first trunk region 251. The winding part 220 is connected between the first end part 222 and the second end part 221, and is covered by the second electrical insulation layer 223. The third branch region 23 has a first end part 232, a second end part 231 and a winding part 230. The first end part 232 is connected to the second trunk region 252. The second end part 231 is opposite to the first end part 232 and is connected to the third trunk region 253. The winding part 230 is connected between the first end part 232 and the second end part 231, and is covered by the third electrical insulation layer 233. The fourth branch region 24 has a first end part 242, a second end part 241 and a winding part 240. The second end part 241 is opposite to the first end part 242 and is connected to the third trunk region 253. The winding part 240 is connected between the first end part 242 and the second end part 241, and is covered by the fourth electrical insulation layer 243.

The transformer 200 in this preferred embodiment includes the transformer winding 2, the insulated coil 3', and a core member 5'. Since the core member 5' is substantially the same as that of the first preferred embodiment, a detailed description of the core member 5' is omitted herein for the sake of brevity.

The core member 5' defines a winding space for accommodating the insulated coil 3' and a portion of the transformer winding 2. The core member 5' is configured with first and second openings 501', 502' that are in spatial communication with the winding space of the core member 5'. During assembling, the winding parts 210, 220, 230, 240 of the first, second, third and fourth branch regions 21, 22, 23, 24 extend around a periphery of the insulated coil 3' in clockwise and counterclockwise directions and in a staggered arrangement. The first, second and third trunk regions 251, 252, 253, the first end part 212 of the first branch region 21 and the first end part 242 of the fourth branch region 24 extend in a same direction through the first opening 501' and extend outward of the core member 5'. It is noted that the first, second and third trunk regions 251, 252, 253, the first end part 212 of the first branch region 21 and the first end part 242 of the fourth branch region 24 are metal without being covered by any electrical insulation layer thereon so as to permit electrical connection with an electrical circuit (such as a circuit board, not shown).

Figure 8:
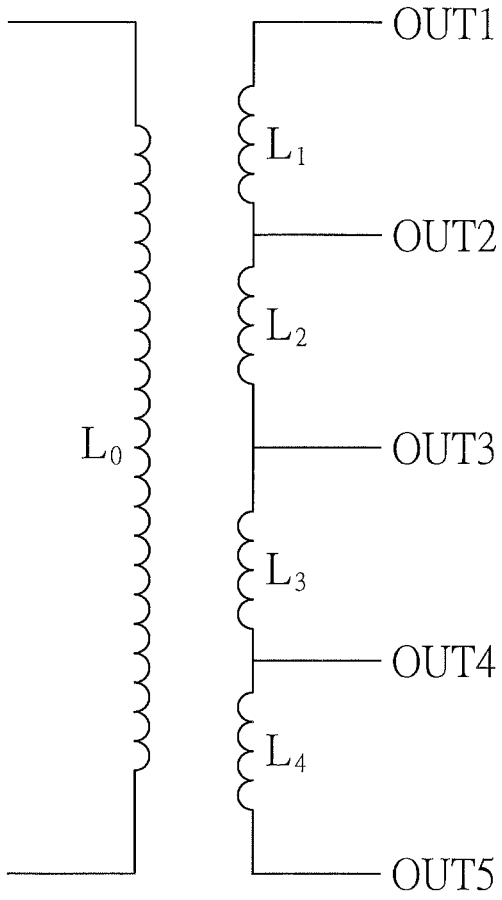
FIG. 8 is a circuit diagram for illustrating an equivalent circuit of the transformer of FIG. 7.

Referring further to FIG. 8, equivalent inductances of the insulated coil 3' and the winding parts 210, 220, 230, 240 of the first, second, third and fourth branch regions 21, 22, 23, 24 in FIG. 7 are respectively represented by $L_0$, $L_1$, $L_2$, $L_3$ and $L_4$ in FIG. 8. The first end part 212 of the first branch region 21, the first trunk region 251, the second trunk region 252, the third truck region 253, and the first end part 242 of the fourth branch region 24 in FIG. 7 are respectively represented as OUT1, OUT2, OUT3, OUT4 and OUT5 in FIG. 8.

To conclude, the transformer windings 1, 2 of the present invention may simplify manufacture of the transformers 100, 200. Moreover, by virtue of the present invention, less heat may be generated, and line loss caused by different materials of electrical conductors may be improved.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A transformer winding comprising:

a flexible metal plate having an outer periphery defining a first side and a second side that are opposite to each other and a third side and a fourth side that are opposite to each other, said flexible metal plate having a first trunk region that extends from said second side toward said first side and that terminates at a first terminating line between said first side and said second side, and being formed with a first cutting line that extends from said first side toward said second side, that is disposed between said third side and said fourth side, and that terminates at said first terminating line, said first cutting line configuring said flexible metal plate with a first branch region and a second branch region, each of said first branch region and said second branch region having a first end part, a second end part opposite to said first end part and connected to said first trunk region, and a winding part that is connected between said first end part and said second end part; and a first electrical insulation layer and a second electrical insulation layer, each of which covers said winding part of a respective one of said first branch region and said second branch region.

2. The transformer winding as claimed in claim 1, wherein said first cutting line is an elongated slot.

3. The transformer winding as claimed in claim 1, wherein:

said flexible metal plate further has a second trunk region that extends from said first side toward said second side, that terminates at a second terminating line between said first side and said second side, and that is connected to said first end part of said second branch region;

said flexible metal plate being further formed with a second cutting line that extends from said second side toward said first side, that is disposed between said first cutting line and said fourth side, and that terminates at said second terminating line;

said second cutting line further configuring said flexible metal plate with a third branch region disposed on one side of said second branch region opposite to said first branch region, said third branch region having a first end part connected to said second trunk region, a second end part opposite to said first end part, and a winding part that is connected between said first end part and said second end part of said third branch region;

said transformer winding further comprising a third electrical insulation layer that covers said winding part of said third branch region.

4. The transformer winding as claimed in claim 3, wherein each of said first cutting line and said second cutting line is an elongated slot.

5. The transformer winding as claimed in claim 3, wherein:

said flexible metal plate further has a third trunk region that extends from said second side toward said first side, that terminates at a third terminating line between said first side and said second side, and that is connected to said second end part of said third branch region;

said flexible metal plate being further formed with a third cutting line that extends from said first side toward said second side, that is disposed between said second cutting line and said fourth side, and that terminates at said third terminating line;

said third cutting line further configuring said flexible metal plate with a fourth branch region disposed on one side of said third branch region opposite to said second branch region, said fourth branch region having a first end part, a second end part opposite to said first end part and connected to said third trunk region, and a winding part that is connected between said first end part and said second end part of said fourth branch region;

said transformer winding further comprising a fourth electrical insulation layer that covers said winding part of said fourth branch region.

6. The transformer winding as claimed in claim 5, wherein each of said first cutting line, said second cutting line and said third cutting line is an elongated slot.

7. A transformer comprising:

a coil bobbin;

an insulated coil wound on said coil bobbin;

a core member coupled to said coil bobbin in a manner that said insulated coil surrounds said core member; and a transformer winding coupled inductively to said insulated coil, said transformer winding including a flexible metal plate having an outer periphery defining a first side and a second side that are opposite to each other and a third side and a fourth side that are opposite to each other, said flexible metal plate having a first trunk region that extends from said second side toward said first side and that terminates at a first terminating line between said first side and said second side, and being formed with a first cutting line that extends from said first side toward said second side, that is disposed between said third side and said fourth side, and that terminates at said first terminating line, said first cutting line configuring said flexible metal plate with a first branch region and a second branch region, each of said first branch region and said second branch region having a first end part, a second end part opposite to said first end part and connected to said first trunk region, and a winding part that is connected between said first end part and said second end part, said transformer winding further including a first electrical insulation layer and a second electrical insulation layer, each of which covers said winding part of a respective one of said first branch region and said second branch region, said transformer winding being disposed to surround said insulated coil with said winding part of each of said first branch region and said second branch region extending around an outer side of said insulated coil.

8. The transformer as claimed in claim 7, wherein said first cutting line is an elongated slot.

9. The transformer as claimed in claim 7, wherein:

said flexible metal plate further has a second trunk region that extends from said first side toward said second side, that terminates at a second terminating line between said first side and said second side, and that is connected to said first end part of said second branch region;

said flexible metal plate being further formed with a second cutting line that extends from said second side toward said first side, that is disposed between said first cutting line and said fourth side, and that terminates at said second terminating line;

said second cutting line further configuring said flexible metal plate with a third branch region disposed on one side of said second branch region opposite to said first branch region, said third branch region having a first end part connected to said second trunk region, a second end part opposite to said first end part, and a winding part that is connected between said first end part and said second end part of said third branch region;

said transformer winding further including a third electrical insulation layer that covers said winding part of said third branch region;

said winding part of said third branch region extending around the outer side of said insulated coil.

10. The transformer as claimed in claim 9, wherein each of said first cutting line and said second cutting line is an elongated slot.

11. The transformer as claimed in claim 9, wherein:

said flexible metal plate further has a third trunk region that extends from said second side toward said first side, that terminates at a third terminating line between said first side and said second side, and that is connected to said second end part of said third branch region;

said flexible metal plate being further formed with a third cutting line that extends from said first side toward said second side, that is disposed between said second cutting line and said fourth side, and that terminates at said third terminating line;

said third cutting line further configuring said flexible metal plate with a fourth branch region disposed on one side of said third branch region opposite to said second branch region, said fourth branch region having a first end part, a second end part opposite to said first end part and connected to said third trunk region, and a winding part that is connected between said first end part and said second end part of said fourth branch region;

said transformer winding further including a fourth electrical insulation layer that covers said winding part of said fourth branch region;

said winding part of said fourth branch region extending around the outer side of said insulated coil.

12. The transformer winding as claimed in claim 11, wherein each of said first cutting line, said second cutting line and said third cutting line is an elongated slot.

13. The transformer as claimed in claim 7, wherein one of said winding part of said first branch region and said winding part of said second branch region extends around said insulated coil in a counterclockwise direction from said first trunk region, and the other one of said winding part of said first branch region and said winding part of said second branch region extends around said insulated coil in a clockwise direction from said first trunk region.

14. The transformer as claimed in claim 13, wherein said core member is configured with an opening that permits extension of said first trunk region, said first end part of said first branch region, and said first end part of said second branch region therethrough.

* * * * *